US005275495A

United States Patent [19]

Wilson, III

[11] Patent Number: 5,275,495

[45] Date of Patent: Jan. 4, 1994

[54] RIBBON RE-INKING MECHANISM

[75] Inventor: Joseph T. Wilson, III, Endicott, N.Y.

[73] Assignee: International Business Machines Corporation, Armonk, N.Y.

[21] Appl. No.: 922,061

[22] Filed: Jul. 29, 1992

[51] Int. Cl.[5] ..... B41J 31/14

[52] U.S. Cl. ..... 400/197; 400/191

[58] Field of Search ..... 400/197, 191, 202.1, 400/202, 202.4

[56] References Cited

U.S. PATENT DOCUMENTS

| | | | |
|---|---|---|---|
| 2,922,506 | 1/1960 | Weller | 400/191 |
| 4,247,209 | 1/1981 | Carlson et al. | 400/202.4 |
| 4,536,098 | 8/1985 | Sheehan et al. | 400/208 |
| 4,616,942 | 10/1986 | Nagasawa et al. | 400/202.4 |
| 4,913,571 | 4/1990 | Bulson et al. | 400/208 |

FOREIGN PATENT DOCUMENTS

| | | | |
|---|---|---|---|
| 0156810 | 5/1904 | Fed. Rep. of Germany | 400/197 |

*Primary Examiner*—Edgar S. Burr
*Assistant Examiner*—Anthony H. Nguyen
*Attorney, Agent, or Firm*—Douglas M. Clarkson

[57] ABSTRACT

A re-inker mechanism is described for replenishing ink in a ribbon by increasing the contact force between an ink supply roller and a transfer roller as the weight of the ink supply roller decreases. This is accomplished by locating the transfer roller rotatably in a fixed position and locating the ink supply roller somewhat beneath the transfer roller on a support that is movable. A biasing force is attached to the ink supply roller to urge the ink supply roller against the transfer roller with a force sufficient to overcome the weight of the ink supply roller and to provide a predetermined contact force between the ink supply roller and the transfer roller, so that as the ink is used, the weight of the ink supply roller decreases and the contact force with the transfer roller increases.

3 Claims, 3 Drawing Sheets

RIBBON RE-INKING MECHANISM

BACKGROUND OF THE INVENTION

1. Field of the Invention

The present invention, generally, relates to ribbon re-inking devices and, more particularly, to a new and improved mechanism by which ink is transferred from an ink reservoir for replenishing the ribbon under a measure of control.

Usually, today, a supply of ink in a pad of porous material is maintained in close contact with a ribbon in a wiping or a rolling action under substantially constant pressure to replenish the ink as the ribbon is used. It is the custom to form such porous material as a circular roller and to mount it within the ribbon cartridge where it is maintained in contact with the ribbon, thereby extending the operating life of the ribbon.

2. Description of the Prior Art

One practice that has found favor in the art today uses a second roller intermediate the porous ink-filled roller, and this roller is called a"transfer" roller.

The ribbon is wrapped part way around the peripheral surface of the transfer roller with the re-inking roller in contact with a different part of the periphery of the transfer roller. Actually, the transfer roller and the re-inking roller are supported rotatably on their own shafts.

Since the re-inking roller and the transfer roller are in contact with each other, as one turns, so turns the other. Thus, as the ribbon is moved by the apparatus using it, this action provides the motive power for turning both the transfer roller and the re-inking roller. Whether such a ribbon is used in a typing apparatus or in an impact printer apparatus, it is the practice today to provide some form of ink replenishing supply.

In impact printer apparatus, it is current practice to augment the supply of ink in the ribbon. This additional ink is contained in a reservoir formed of porous, sponge-like material in the shape of a circular roller, and the transfer roller is located between the ribbon and this ink supply roller.

It is also current practice for such impact printers to enclose both the ribbon and the re-inking mechanism in a cartridge. These cartridges, however, have not been a panacea in extending the operating life of the ribbon, because they have had their own problems.

The patented prior art describes several arrangements for re-inking devices. For example, U.S. Pat. No. 2,770,215 to Knight describes an early form of a device for furnishing ink continuously to an inked ribbon.

U.S. Pat. No. 4,536,098 to Sheehan et al. describes a ribbon cartridge with a re-inking mechanism to extend the life of the ribbon.

U.S. Pat. No. 4,913,571 to Bulson et al. describes a ribbon cartridge with a re-inking roller and transfer roller assembly arranged to prevent a failure due to a long period of non-use. This patent is assigned to the Assignee of the present invention.

While the structural arrangements of these prior devices, at first appearance, have similarities with the present invention, they differ in material respects. These differences, which will be described in more detail presently, are important for the effective use of the invention to achieve its advantages.

OBJECTS AND SUMMARY OF THE INVENTION

It is an important object of the present invention to provide a mechanism for re-inking a ribbon to maintain print density substantially constant over a longer period than available with previous devices.

Another important object of the invention is to provide a mechanism for re-inking a ribbon that increases the contact force between an ink supply roller and a transfer roller as the supply of ink decreases.

Briefly, a ribbon re-inking mechanism that is constructed and arranged according to the principles of the invention includes a transfer roller for transferring ink to a ribbon as the ribbon moves in contact with a part of the periphery of the transfer roller. An ink supply roller is located to contact a different part of the periphery of the transfer roller away from the ribbon and so that the weight of the ink supply roller, when fully loaded with ink, tends to move the ink supply roller out of contact with the transfer roller. A biasing force is applied to the ink supply roller to overcome the force due to its weight by an amount so that the ink supply roller is urged against the transfer roller with a predetermined force.

The above and other objects, features and advantages of the present invention will become more readily apparent as the detailed description of the presently preferred embodiment proceeds.

BRIEF DESCRIPTION OF THE DRAWINGS

The present invention will be described with reference to the accompanying drawings, in which.

DETAILED DESCRIPTION OF THE INVENTION

While an inked ribbon is used in a variety of apparatus, it has been learned some time ago that the useful operating life of such an inked ribbon can be extended substantially when the ink is replenished during operation, and a variety of devices have been suggested to accomplish such ribbon re-inking. With an arrangement according to the present invention, the operating life of such an inked ribbon is extended even further.

Figure 1:
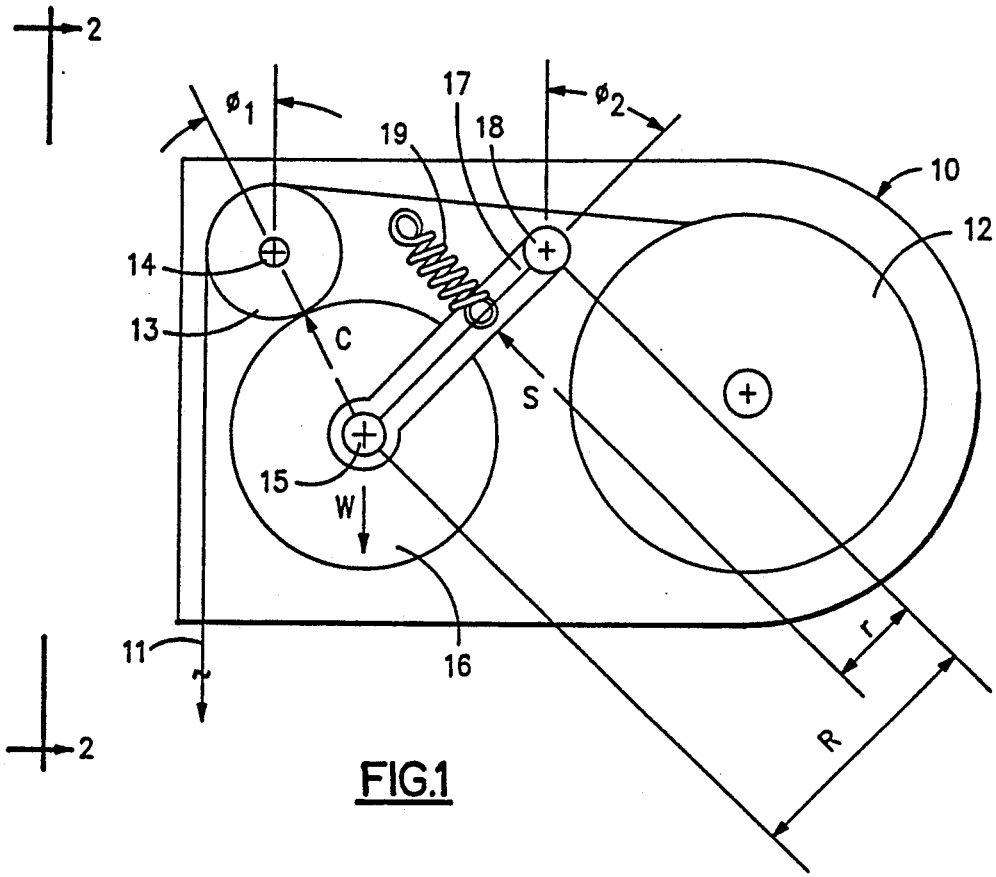
FIG. 1 is a side view in elevation showing the structural arrangement of the invention.

In FIG. 1 of the drawings, the numeral 10 identifies a cartridge from which an inked ribbon 11 is furnished to a work station of an apparatus (not shown). A supply reel 12 contains a pre-measured quantity of the inked ribbon, which moves from the supply reel 12 over a part of the periphery of an ink transfer roller 13 before it exits the cartridge 10.

Of course, it will be understood by those skilled in this art that whether the inked ribbon 11 moves out of the cartridge 10 or is returned to the cartridge and wound onto the reel 12 depends upon a ribbon reversing action that may or may not be a part of the apparatus that uses the ribbon. Therefore, it will be understood that the action of the re-inking mechanism of the invention is not dependent upon the direction of travel of the ribbon 11.

In some prior arrangements, the shaft 14 of the transfer roller 13 is supported in a movable manner, but in an arrangement according to the invention, the shaft 14 is supported in a fixed position within the ribbon cartridge 10. However, a shaft 15 on which an ink supply roller 16 is rotatable is supported in a movable manner in a direction toward and away from the transfer roller 13.

Furthermore, the location of the shaft 15 is below the shaft 14, so that a separate biasing force must be furnished to raise the ink supply roller 16 against the transfer roller 13. The action provided by this biasing force is important to achieve the advantages of the invention and will be described in more detail now.

In the form of the invention illustrated in FIG. 1 of the drawings, the shaft 15 of the ink supply roller 16 is supported by a lever 17 that is pivotable about axis 18. A spring 19 is attached to the lever 17 to urge the lever with a force S to overcome the weight W and to apply a contact force C against the transfer roller 13.

The distance R is a moment arm from the shaft 18 to the shaft 15, and the distance r is a moment arm from the shaft 18 to the force S. An angle $\phi_1$ illustrates the degree of variance for the force C from the vertical, and an angle $\phi_2$ illustrates the degree of variance for the force S from the vertical.

Figure 2:
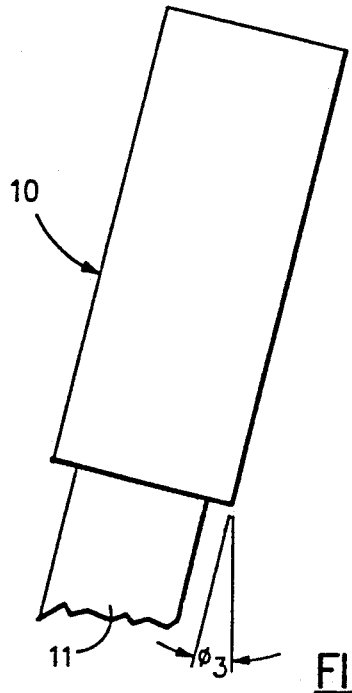
FIG. 2 is a view taken along the line 2—2 in FIG. 1 showing the tilt that is possible, as an aid in the description of the invention.

Also, as best illustrated in FIG. 2, the cartridge 10 can be tilted at an angle $\phi_3$ from the vertical. This can have a bearing on the weight W as it relates to the present invention.

The relationship between the forces described above is given as follows:

$$C = \frac{r(S)}{R\sin(\phi_1 + \phi_2)} - \frac{W\cos\phi_3\sin\phi_2}{\sin(\phi_1 + \phi_2)} \quad (1)$$

where: C=the contact force between the ink supply roller and the transfer roller;

S=the biasing force applied to urge the ink supply roller toward the transfer roller;

r=the moment arm of the force S;

R=the moment arm of the support for the ink supply roller;

W=the force exerted by the ink supply roller due to its weight;

$\phi_1$=the angle between force C and vertical;

$\phi_2$=the angle between force S and vertical;

$\phi_3$=the tilt angle between the cartridge and vertical;

To determine the effect of a change in weight of the supply roller 16 on the contact force C between the ink supply roller and the transfer roller 13, the Equation (1) above is differentiated with respect to the weight W, as follows:

$$\frac{dC}{dW} = \frac{-\cos\phi_3(\sin\phi_2)}{\sin(\phi_1 + \phi_2)} \quad (2)$$

where the elements are as defined above.

To illustrate the equation (2) with an actual example, assume that $\phi_1$=49 degrees, $\phi_2$=39.2 degrees and $\phi_3$=42.8 degrees. Substituting these values in equation (2) yields:

$$\frac{dC}{dW} = -0.4640$$

By the above example, it is illustrated that every gram of ink that is removed from the ink supply roller 16 increases the contact force C by 0.4640 grams. Therefore, equation (2) is a useful guide in developing a particular arrangement in accordance with the present invention.

The principles according to the present invention permits substantial freedom of arrangement for the respective component parts. For example, the rate of increase in the contact force C between the ink supply roller 16 and the transfer roller 13 can be made significantly greater than the rate at which ink is removed from the ink supply roller.

The moment arms r and R can be changed readily to increase the effectiveness of the spring force S, by one skilled in the art, thereby changing the force C. Also, the performance of the ink supply roller 16 can be altered readily by altering such factors as porosity, elasticity, density, etc, of the roller material.

Changes can be made also in the characteristics of the ink itself. For example, changes can be made readily in the viscosity of the ink, and the consistency of the ink can be increased or decreased as desired to meet any practical situation, as well as any combination of these features.

Figure 3:
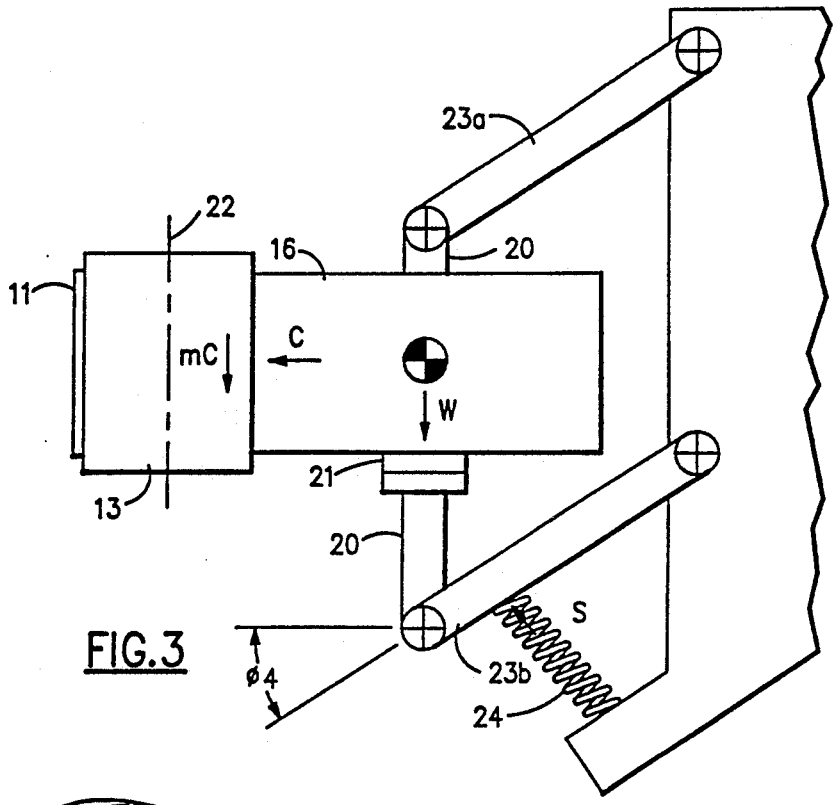
FIG. 3 is a view of a modification to illustrate the principles of the invention.

As illustrated in FIG. 2, when the plane of the ink cartridge 10 is made nearly horizontal, i.e., the angle $\phi_3$ is made close to 90 degrees, a loss in weight W will not produce a significant increase in the force C with the arrangement shown in FIG. Nevertheless, the principles of the invention are still applicable with an arrangement illustrated in FIG. 3.

In FIG. 3 of the drawings, the same reference numerals identify the same, or comparable, component parts. For example, the ink supply roller 16 is illustrated, but here it is on an axis 20 that is vertical. Since the weight W of the ink supply roller 16 is acting downwardly, as viewed in FIG. 3, and since the roller 16 should be rotatable readily, a bearing support is identified by the numeral 21.

The ribbon 11 is movable out from the page as viewed in this FIG. 3 over the transfer roller 13, as described in connection with FIG. 1 previously. Therefore, the axis 22 in FIG. 3 is the line of the shaft 14 in FIG. 1, and the force C is still the contact force between the ink supply roller 16 and the transfer roller 13.

As described previously, the ink supply roller 16 rotates freely on its axis 20, and to develop the contact force C against the transfer roller 13, the axis 20 joins two levers **23*a* and 23*b* that are arranged parallel relative to each other at an angle $\phi_4$ with the horizontal. A compression spring 24 provides a biasing force against the levers 23*a* and 23*b* to develop the force C against the transfer roller 13**.

The coefficient of friction between the ink supply roller 16 and the transfer roller 13 is identified by the letter "m", and therefore, the force mC, as viewed in the FIG. 3, is the force C multiplied by the value of m. A force analysis, as described previously in connection with FIG. 1, for the lever arrangement illustrated in FIG. 3 gives the effect of a change in the weight W for the ink supply roller 16 on the force C as follows:

$$\frac{dC}{dW} = \frac{-1}{\tan \phi_4 - m} \quad (4)$$

In re-inker devices used heretofore, the contact force between the ink supply roller and the transfer roller is maintained constant. In these prior devices, the rate that ink is released to the transfer roller decreases with ink usage. However, in contrast, the arrangement according to the present invention increases the contact force between the ink supply roller and the transfer roller with ink usage, and therefore, the ink release rate is kept more nearly constant, thereby providing all the advantages described below.

Figure 4:
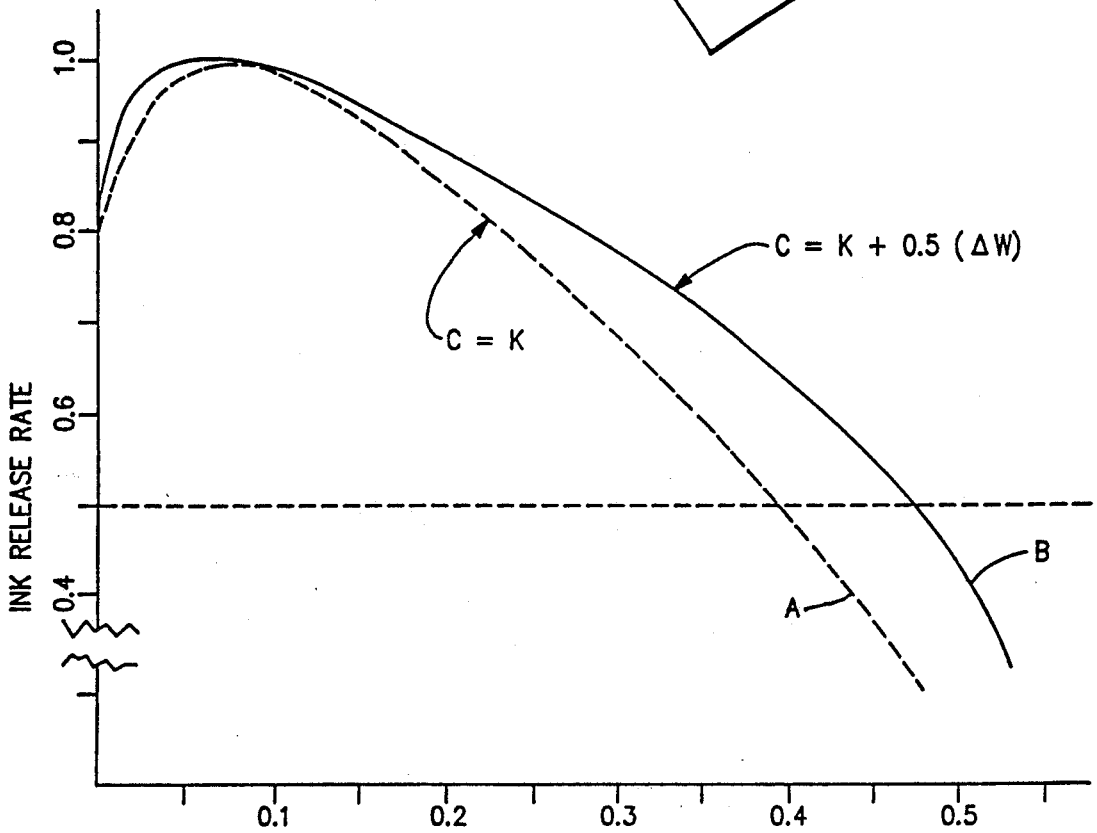
FIG. 4 is a curve showing the extended performance that an arrangement in accordance with the present invention provides.

In other words, if the contact force C remains constant, the rate at which ink is released from the ink supply roller 16 decreases as the amount of ink in the ink supply roller decreases. FIG. 4 illustrates this fact graphically.

For example, curve A shows the ink released when the contact force C is maintained constant (k). One test that has been made revealed that the print density in an impact printer starts to decrease noticeably when the ink release rate is less than 0.5.

For curve A, the reduction in print density becomes noticeable when 39% of the ink has been released from the ink supply roller 16. For curve B, the contact force C is increased at 50% of the rate at which the weight W decreases in the ink supply roller 16.

Therefore, increasing the contact force C with ink usage expands both the portion of printing done at high print density and the portion of ink available for printing.

The performance of the ink supply roller 16 that is illustrated in FIG. 4 is unique to such characteristics as the roller porosity, its elasticity and the density available. For the ink, FIG. 4 shows that such characteristics as viscosity, surface tension, etc., will affect this performance, and also, an increase in performance can be affected by a combination of different inks and roller characteristics.

Figure 5:
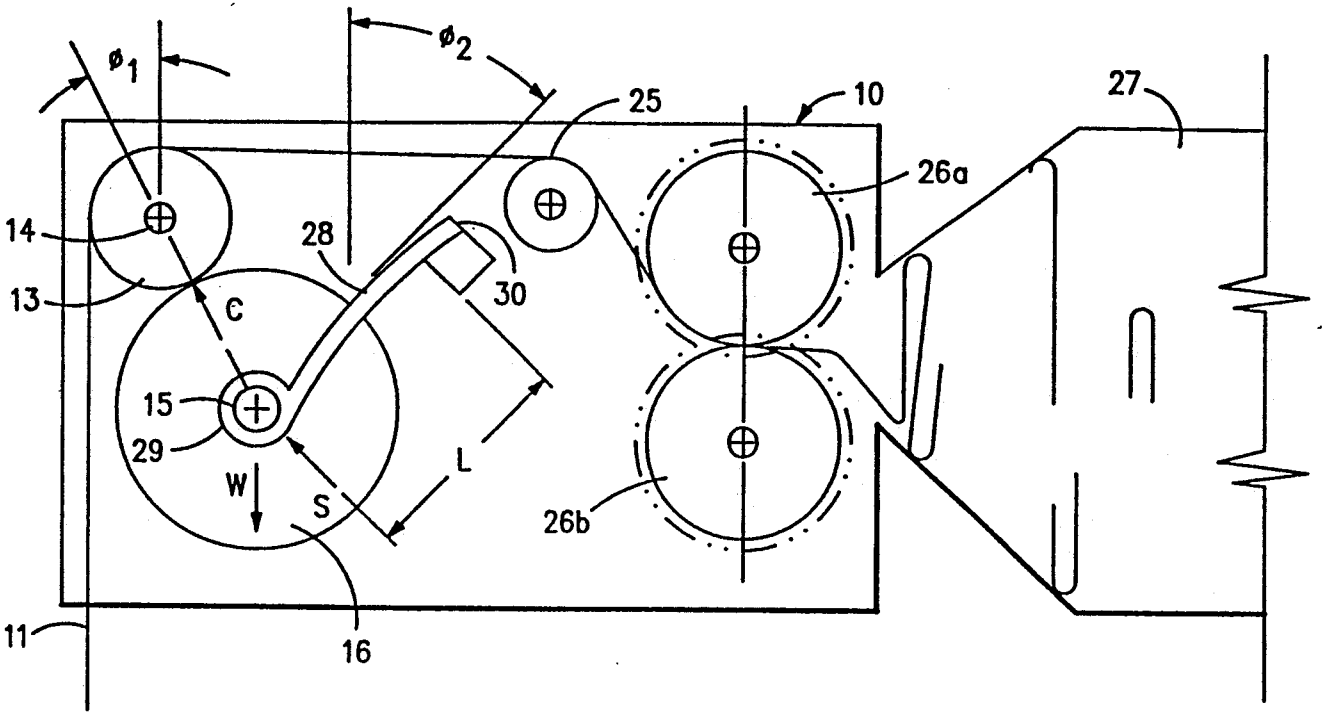
FIG. 5 is another modification of the invention.

Another modification of the invention is illustrated in FIG. 5 of the drawings, where the same reference numerals identify the same or comparable component parts as described in connection with previous figures. For example, the ribbon 11 passes around a portion of the periphery of the transfer roller 13, except that here, the ribbon 11 also passes around part of the periphery of a guide roller 25.

Meshing gears 26*a* and 26*b* grip the ribbon 11 for either pulling it out of, or stuffing it into, a ribbon storage compartment 27, the ribbon 11 being endless, if desired. One of the meshing gears is turned by a motor, not shown.

In this form of the invention, the shaft 15 that provides rotatable support for the ink storage roller 16 is on an arm 28 at an end 29. The arm 28 is fixedly attached at its opposite end 30 in an appropriate way.

The arm 28 is flexible by construction, and it is installed by deflecting it so that the ink supply roller 16 bears against the transfer roller 13 with a force C, as described previously above. Therefore, as the ink is used from the ink supply roller 16, the weight W will decrease, making the force C to increase.

There are factors that influence the action of the flexible arm 28 which, with an understanding of the result to be achieved by the arrangement according to the invention, will be appreciated also. For example, the length of the flexible arm 28 provides a moment arm L for influencing the magnitude of the force S, and the angle $\phi_2$ that the force S bears to the vertical will influence the effective magnitude of the force S.

To express the above described relationship in mathematical terms, it appears similar to equation (1) above, as follows:

$$C = \frac{S - W \cos \phi_3 \sin \phi_2}{\sin(\phi_1 + \phi_2)} \quad (5)$$

As in equation (2), described above, a change in weight of the ink supply roller 16 is determined by a simple differentation of the force C, as follows:

$$\frac{dC}{dW} = \frac{-\cos \phi_3 \sin \phi_2}{\sin(\phi_1 + \phi_2)} \quad (6)$$

The invention has been shown, described and illustrated in substantial detail with reference to the presently preferred embodiment. It will be understood by those skilled in this art that changes and modifications may be made without departing from the spirit and scope of the invention which is defined by the appended claims.

What is claimed is:

1. A re-inker mechanism for maintaining print density substantially constant over an extended period of time as a supply of ink to a ribbon decreases during operation, comprising:

ink transfer roller means supported rotatably for turning with a ribbon in contact with a portion of its periphery;

ink supply roller means for containing a supply of an ink with a predetermined weight;

lever means to support said ink supply roller means rotatably in a position beneath said ink transfer roller means at a location on its periphery away from said portion in contact with said ribbon;

biasing force means located to urge said lever means and said ink supply roller means upwardly into contact with said ink transfer roller means with sufficient force to overcome said predetermined weight of said ink and to provide a predetermined contact force between said ink supply roller means and said ink transfer roller means; and said biasing force means develops a force given by the relationship:

$$c = \frac{r(S)}{R \sin(\phi_1 + \phi_2)} - \frac{W \cos \phi_3 \sin \phi_2}{\sin(\phi_1 + \phi_2)}$$

where: C=the contact force between the ink supply roller means and the ink transfer roller means;

S=the biasing force;

r=the moment arm of the force S;

R=the moment arm of a support for the ink supply roller means;

W=the weight of the ink supply roller means;

$\phi_1$=angle between force C and vertical;

$\phi_2$=angle between force S and vertical;

$\phi_3$=angle of re-inker mechanism tilt;

whereby said predetermined contact force between said ink supply roller means and said ink transfer means is increased as the ink supply in said ink supply roller means is decreased.

2. A re-inker mechanism for maintaining print density substantially constant over an extended period of time as a supply of ink to a ribbon decreases during operation, comprising:

ink transfer roller means supported rotatably for turning with a ribbon in contact with a portion of its periphery;

ink supply roller means for containing a supply of an ink with a predetermined weight;

lever means to support said ink supply roller means rotatably in a position beneath said ink transfer roller means at a location on its periphery away from said portion in contact with said ribbon;

biasing force means located to urge said lever means and said ink supply roller means upwardly into contact with said ink transfer roller means with sufficient force to overcome said predetermined weight of said ink and to provide a predetermined contact force between said ink supply roller means and said ink transfer roller means; and said biasing force means is developed by a flexible lever fixed at one end and supporting said ink supply roller means at a predetermined distance from said one end to provide a contact force against said ink transfer roller means given by the relationship:

$$c = \frac{S - W\cos\phi_3 \sin\phi_2}{\sin(\phi_1 + \phi_2)}$$

where: C=the contact force between the ink supply roller means and the ink transfer roller means;

S=the force developed by the flexed lever;

W=the weight of the ink supply roller means;

$\phi_1$=angle between C and vertical;

$\phi_2$=angle between S and vertical; and $\phi_3$=angle of re-inker mechanism tilt;

whereby said predetermined contact force between said ink supply roller means and said ink transfer means is increased as the ink supply in said ink supply roller means is decreased.

3. A re-inker mechanism as defined by claim 2 wherein said change in weight of said ink supply roller means produces a change in said contact force given by the relationship:

$$\frac{dC}{dW} = \frac{-\cos\phi_3 \sin\phi_2}{\sin(\phi_1 + \phi_2)}$$

where: $\phi_1$=angle between C and vertical;

$\phi_2$=angle between S and vertical; and $\phi_3$=angle of re-inker mechanism tilt.

* * * * *